United States Patent [19]

Urasaki

[11] 4,240,600

[45] Dec. 23, 1980

[54] KITE-FLYING TOY

[76] Inventor: Tatsuo Urasaki, 4-58-7, Nanashinodai, Funabashi-shi, Chiba-ken, Japan

[21] Appl. No.: 98,530

[22] Filed: Nov. 29, 1979

[51] Int. Cl.[3] ..... B64C 31/06; A63H 27/08

[52] U.S. Cl. ..... 244/155 R

[58] Field of Search ..... 244/155 R, 155 A, 153 R; 46/86 R; 43/4, 4.5, 43.13

[56] References Cited

U.S. PATENT DOCUMENTS

| | | | |
|---|---|---|---|
| 563,066 | 6/1896 | Rogers | 244/155 R |
| 2,535,165 | 12/1950 | Shoemaker | 244/155 R |
| 3,227,404 | 1/1966 | Scharge | 244/155 R |
| 3,960,347 | 6/1976 | Strifzke | 244/155 R |
| 3,968,948 | 7/1976 | Schmidt | 244/155 R |

FOREIGN PATENT DOCUMENTS

| | | | |
|---|---|---|---|
| 379036 | 8/1936 | United Kingdom | 244/155 R |

*Primary Examiner*—Galen L. Barefoot

*Attorney, Agent, or Firm*—Sherman & Shalloway

[57] ABSTRACT

A kite-flying toy which can be lifted along a string from a player's hand to a position immediately before a kite hovering in the air, and which can be struck to a stopper provided just before the kite thereby to unlock a wing-holding means thereby to close the wings, so that the toy falls to the player's hand by its empty weight along the string. The toy comprises two frames, i.e., a vertical frame and a lateral frame, wherein the vertical frame is tilted or tiltable toward the player relative to the lateral frame so that the wings receive the wind pressure efficiently responsive to the angle of the string.

5 Claims, 6 Drawing Figures

KITE-FLYING TOY

BACKGROUND OF THE INVENTION

1. Field of the Invention

This invention relates to a kite-flying toy, and more particularly to a kite-flying toy which lifts up to a position immediately before a kite hovering in the air along a string and which falls onto the hand.

2. Description of the Prior Art

Many people enjoy flying kites inclusive of European kites in the air. To make the kites more interesting and amusing, people exert much effort on the design of kites and patterns to be described thereon. However, no matter how eccentric or queer the shapes and patterns of these kites may be, there inevitably lies limitation to the factor of amusement. Particularly, when the direction of wind and the wind speed are constant, the kite simply rises to a given height and remains almost stationary to present no further amusement.

Therefore, an accessory toy has heretofore been proposed, which has a wing to receive wind pressure to ascend and descend along a string stretched by a hovering kite. Accessory toys of this kind, however, are unexceptionally complex in construction and heavy in weight. Besides, with such toys, the angle between the string which serves as a guide and the wing is fixed to right angles regardless of the angle of the string with respect to the horizontal level. Consequently, when the kite is hovering above the head (extremely speaking, when the angle of the string is 90° with respect to the ground), the wing of the toy is in parallel with the wind. Namely, the wing receives almost no wind pressure, and the toy does not rise.

SUMMARY OF THE INVENTION

The principal object of this invention is to provide a kite-flying toy which is free of the above-mentioned defects inherent in the conventional counterparts.

Another object of the invention is to provide a kite-flying toy which is so designed that its wing receives suitable wind pressure even when the angle of a kite string is at right angles with the ground, i.e., even when the kite is hovering about the player's head.

A further object of the invention is to provide a kite-flying toy which is capable of positively adjusting the angle of the wing responsive to the angle of the string or wind speed, thereby to enhance the reliability in operation.

A still further object of the invention is to provide a kite-flying toy which is simple in construction and which has a minimum wing load (total weight with respect to the lifting force of the wing).

Yet further object of the invention is to provide a kite-flying toy which will not give such danger as injuring the player's eyes or the like, and which is very safe to play with.

According to an embodiment of this invention, the body of the toy comprises a nearly T-shaped frame. A vertical frame connected to the center of a lateral frame has a reduced thickness at a portion just beneath the connected portion, or has a hinge, and is allowed to be bent in the back and forth directions.

In other words, the vertical frame mounting the wings can be freely adjusted such that the wings most efficiently receive the wind pressure depending upon the angle of the string with respect to the horizontal direction.

According to another embodiment of the invention, the vertical frame is not made adjustable as mentioned above, but is bent toward the front in a T-shape such that the wing will cover the broadest range of effective angles.

Other objects and advantages of the invention will become apparent from the description of the invention taken in conjunction with the accompanying drawings.

DESCRIPTION OF THE PREFERRED EMBODIMENTS

Figure 1:
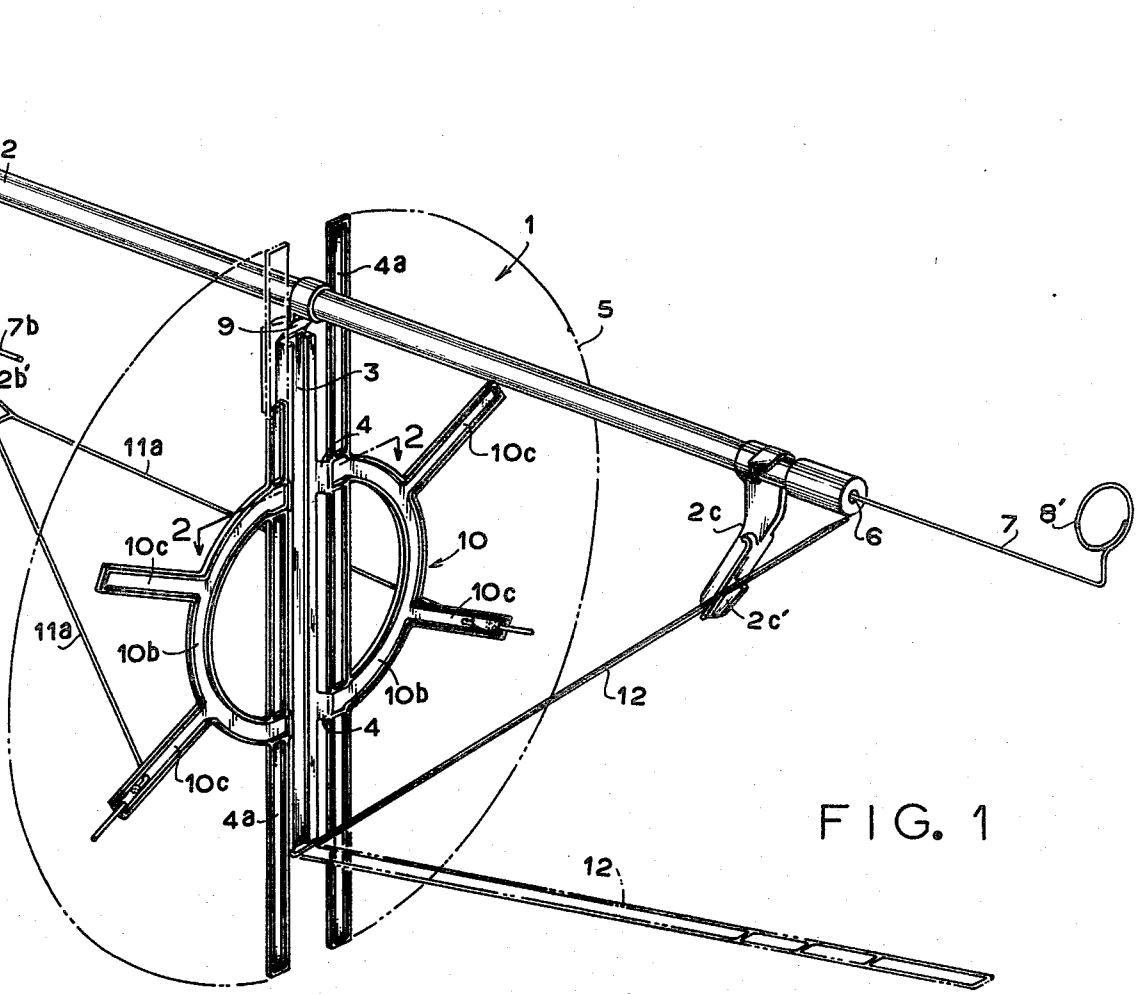
FIG. 1 is a perspective view showing a kite-flying toy according to an embodiment of this invention.

FIG. 1 is a perspective view illustrating the state in which the wings of a kite-flying toy according to an embodiment of this invention are opened. The left side (hereinafter called the front side) of the drawing faces the player and the kite is located on the right side (hereinafter called the rear side) of the drawing. The toy 1 consists of a lateral frame 2 and a vertical frame 3 which constitute a nearly T-shaped frame. Wings 5 are attached to the vertical frame 3 via a hinge which will be mentioned later, and are allowed to be opened and closed. The lateral frame 2 has a through hole 6 which is formed in the axial direction thereof. An operation rod 7 is inserted in the through hole 6 so as to move therein in a reciprocating manner. Both ends of the operation rod 7 are upwardly folded to form ring-like string-passing portions 8,8' through which the kite string will pass. Particularly, the string-passing portion 8' on the right side of the drawing also works as a stopper which prevents the operation rod 7 from being removed from the through hole 6 of the lateral frame 2 during transit. The front side of the operation rod 7 is extended beyond the base portion of the string-passing portion 8 and is downwardly folded to form a first folded portion 7*a*. The first folded portion 7*a* is further extended and is folded back toward the rear direction to form a second folded portion 7*b*. The second folded portion 7*b* is secured being inserted in a hollow portion 2*b'* of a stop portion 2*b* which is attached, nearly in parallel with the lateral frame 2, to a lower end of a support portion 2*a* which downwardly stretches from the rear end of the lateral frame 2.

Construction related to the vertical frame 3 is mentioned below in detail. The vertical frame 3 is attached to the lateral frame 2 in a nearly T-shaped via a rotary coupling portion 9. On both the right and left sides of the vertical frame 3 are provided wing-mounting frames 10 via hinges 4. If mentioned in further detail, the wing-mounting frames 10 have a vertical member 4*a* attached thereto via a hinge 4 in parallel with the vertical frame 3, an arc-like intermediate member 10b which is outwardly stretched from the central portion of the vertical member 4*a*, and end members 10*c* which are outwardly stretched from the intermediate members 10*b* toward the right and left directions each in a number of two. To each of the wing-mounting frames 10 is fastened a semicircular wing (as indicated by two-dot chain lines).

Fine cords 11*a* of a wing-opening means 11 are fastened to one of the end members 10*c* on the left side of the wing-mounting frame 10 and to one of the end members 10*c* on the right side of the wing-mounting frame 10. The other ends of the fine cords 11*a* are connected together by an adjusting portion 11*b*. According to the embodiment of this invention as will be mentioned later, the wings can be adjusted into three angles. The adjusting portion 11b consists of a nearly equally shaped mesh-like stop portions. On the lower portion of the vertical frame 3 is provided a rear adjusting member 12 for adjusting the angle of the wings relative to the wing-opening means 11. Like the adjusting portion 11b of the wing-opening means 11, the rear adjusting member 12 is formed in a mesh-like structure over its full length. When the wings are to be open, the rear adjusting member 12 having mesh-like structure is suitably engaged with a hook 2*c*′ of a rear stop member 2*c* which is downwardly formed from the end of the operation rod 7. Namely, the angle of the vertical frame 3 relative to the lateral frame 2 or the angle of the wings varies depending upon which meshes of the adjusting member 11*b* of the wing-opening means 11 and of the rear adjusting member 12 are hooked to the folded portions 7*a* and 7*b* of the operation rod 7 and to the rear stop member 2*c*.

Figure 3:
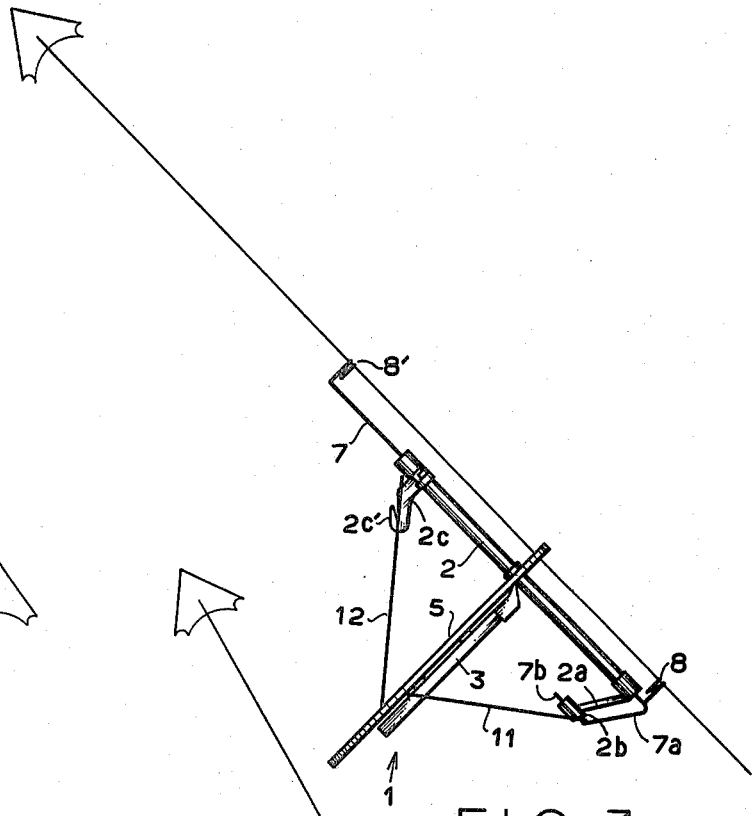
FIGS. 3 to 5 are side views illustrating the states in which the toy of the invention is being used.
Figure 5:
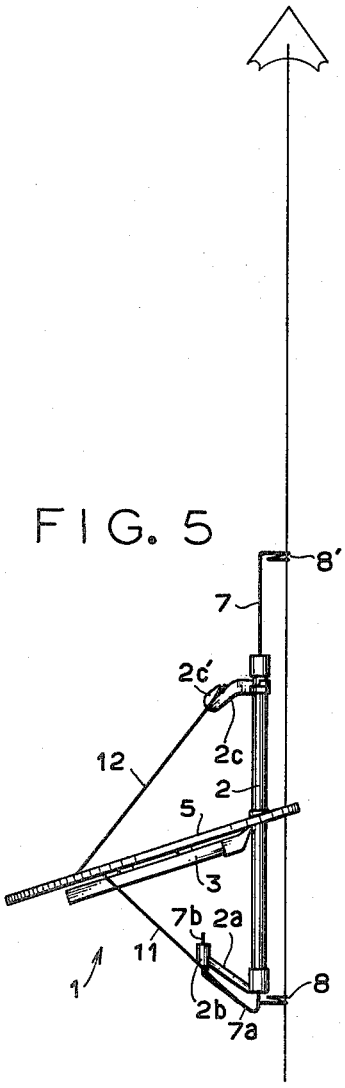
Figure 4:
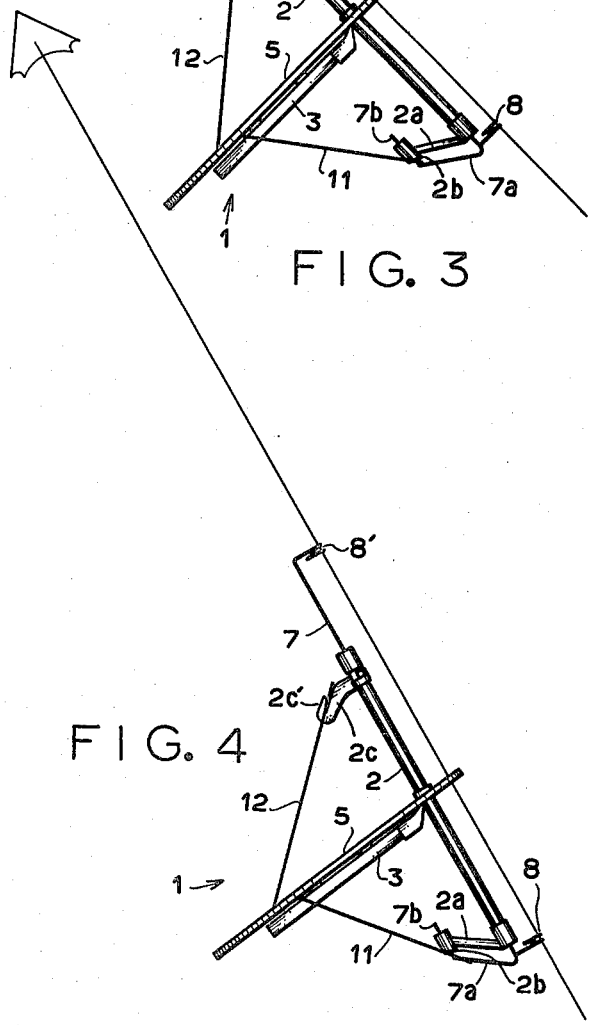

FIGS. 3 to 5 are side views for illustrating ideal angles of the wings of the toy 1 according to this invention with respect to the angle of the string and the wind speed.

Referring to FIG. 3, when the kite is hovering at an angle of about 20° to 45° with respect to the horizontal line, the angle between the lateral frame 2 and the vertical frame 3 of the toy 1 should be nearly at right angles as employed by the conventional art. To attain such a state, the innermost mesh among the three consecutive meshes of the adjusting portion 11b of the wing-opening means 11 is hooked to the second folded portion 7*b* formed at the front portion of the operation rod 7, and the second folded portion 7*b* is inserted and stopped in the hollow portion 2*b*′ of the stop portion 2*b* which is formed via the support portion 2*a* at the front end of the lateral frame 2. Since the wings have already been opened by the wing-opening means 11, the vertical frame 3 is gradually opened as the rear adjusting member 12 attached to the lower portion of the vertical frame 3 is pulled forward. In other words, since the vertical frame 3 is connected to the lateral frame 2 via a rotary coupling portion 9, the vertical frame 3 is turned forward. Thereafter, when the vertical frame 3, i.e., when the wings reached a position at which the wings are at right angles with the lateral frame 2 (FIG. 3), a suitable mesh of the rear adjusting member 12 is hooked to the hook 2*c*′ of the rear stop member 2*c* provided at the tip of the operation rod 7 and is reliably secured thereto. The thus constructed toy 1 is slidably fitted to the string by means of the string-passing portions 8, 8′ as shown in FIG. 3. The wings maintain a suitable angle with respect to the direction of the wind, i.e., the wings suitably receive the wind pressure. Then, the toy 1 advances along the string and reaches the position immediately before the kite or reaches the stopper (not shown) which is directly attached to the kite, whereby the tip of the operation rod 7 hits the stopper. Consequently, the operation rod 7 is moved toward the front side through the through hole 6 of the lateral frame 2. As a result, the second folded portion 7*b* moves forwards and is disengaged from the hollow portion 2*b*′ of the stop portion 2*b* which is located at the front portion of the operation rod 7 and, at the same time, the mesh of the adjusting portion 11*b* of the wing-opening means 11 is disengaged from the second folded portion 7*b* at the tip of the operation rod 7. Then, the wings 5 are closed due to the wind pressure. The toy falls due to its empty weight and returns to the hand of the player along the string 13.

Below is mentioned when the kite is hovering at an angle of 46° to 75° with respect to the horizontal level as shown in FIG. 4. In this case, the wings 5 should be slightly tilted toward the front surface of the toy 1 relative to the lateral frame 2 and the string, so that the wings receive suitable wind pressure to ascend. In this case, therefore, the length of the wing-opening means 11 must be slightly larger than that of FIG. 3. Hence, a middle mesh among the three consecutive meshes of the adjusting portion 11*b* of the wing-opening means 11 is selected and is hooked to the second folded portion 7*b* which is formed at the front portion of the operation rod 7. In this case, while the length of the wing-opening means 11 is increased by one mesh, the length of the front adjusting member 12 is shortened by one mesh.

When the kite is hovering at an angle of 76° to 90° as shown in FIG. 5, the wings 5 must be more tilted toward the rear of the toy 1 relative to the lateral frame 2 and the string than that of FIG. 4, so that the toy receives suitable wind pressure and ascends. In this case, therefore, the length of the wing-opening means 11 must be larger than that of FIG. 4. Hence, the outermost mesh among the three consecutive meshes of the adjusting portion 11b of the wing-opening means 11 is selected and is hooked to the second folded portion 7*b* formed at the front portion of the operation rod 7, like the case of FIG. 3. Accordingly, while the length of the wing-opening means 11 is increased by one mesh, the length of the rear adjusting member 12 is further shortened by one mesh.

Although the foregoing embodiment has dealt with the case in which the vertical frame 3 is rotatably attached to the lateral frame 2, it will be obvious that the invention also encompasses an embodiment in which the vertical frame 3 is fixed to the lateral frame 2 at an angle $\theta$ over a range of $90° > \theta \geqq 45°$ as illustrated in FIGS. 4 and 5.

Figure 6:
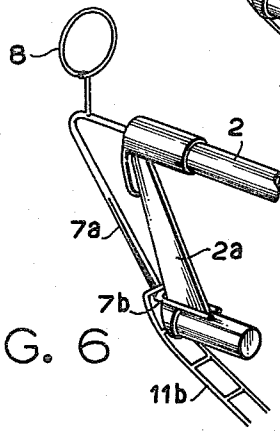
FIG. 6 is a view showing, on an enlarged scale, an important portion of the invention according to a modified embodiment.
Figure 2:
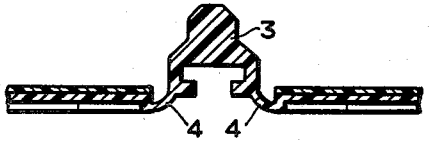
FIG. 2 is a view illustrating a portion for opening and closing the wings of FIG. 1.

FIG. 6 is a diagram illustrating a modified embodiment according to this invention, in which the second folded portion 7*b* at the rear end of the operation rod 7 of the embodiment of FIG. 1 is separated into two in the shape of a fork, and is fitted to the support portion 2*a* to set the operation rod 7.

According to the kite-flying toy of this invention as mentioned in the foregoing, the angle of the wings is automatically adjusted so as to receive a suitable wind pressure relative to the angle of the string and the wind speed and the wings are reliably set to an optimum angle even when the kite is hovering above the head of the player.

According to the invention, furthermore, the construction is generally simplified, and the weight of the toy is reduced.

What is claimed is:

1. A kite-flying toy comprising:

(a) a lateral frame having a through hole in the axial direction thereof;

(b) an operation rod which is movably inserted in said lateral frame, and which has a folded portion for engagement at the front end thereof as well as kite string-passing portions at suitable portions thereof;

(c) a front stop member which is downwardly provided at a front portion of said lateral frame and with which will engage said folded portion of said operation rod;

(d) a vertical frame which is attached via a rotary coupling portion to nearly a central portion of said lateral frame and which downwardly extends;

(e) a pair of wing-mounting frames which are stretched via rotary portions on both sides of said vertical frame;

(f) a pair of wings mounted on said wing-mounting frames;

(g) a wing-opening means of which the ends on one side are fastened to suitable places of said pair of wing-mounting frames, and of which the end on the other side has a plurality of engaging portions formed as a unitary structure;

(h) a rear adjusting means which is fastened to the lower portion of said vertical frame and which has a plurality of hooking portions in the lengthwise direction thereof; and (i) a rear stop member which has a hook to which will be hooked said adjusting means and which is downwardly formed from the tip of said lateral frame.

2. A kite-flying toy as set forth in claim 1, wherein the tip of the folded portion of said operation rod has a forked portion which engages with said front stop member.

3. A kite-flying toy as set forth in claim 1, wherein said front stop member has a through hole oriented in a direction nearly in parallel with said operation rod.

4. A kite-flying toy comprising:

(a) a lateral frame having a through hole in the axial direction thereof;

(b) an operation rod which is movably inserted in said lateral frame, and which has a folded portion for engagement at the front end thereof as well as kite string-passing portions at suitable portions thereof;

(c) a front stop member which is downwardly provided at a front portion of said lateral frame and with which will engage said folded portion of said operation rod;

(d) a vertical frame which is secured to nearly a central portion of said lateral frame with an angle of inclination, and which downwardly extends;

(e) a pair of wing-mounting frames which are stretched via rotary portions on both sides of said vertical frame;

(f) a pair of wings mounted on said wing-mounting frames;

(g) a wing-opening means of which the ends on one side are fastened to suitable places of said pair of wing-mounting frames, and of which the end on the other side has a engaging portion formed as a unitary structure;

(h) a rear adjusting means which is fastened to the lower portion of said vertical frame and which has a hooking portion in the lengthwise direction thereof; and (i) a rear stop member which has a hook to which will be hooked said adjusting means and which is downwardly formed from the tip of said lateral frame.

5. A kite-flying toy as set forth in claim 1, wherein an interior angle $\theta$ of said vertical frame with reference to said lateral frame exists within the range of $90° > \theta \geqq 45°$.

* * * * *